US009981484B1

(12) United States Patent
Moore et al.

(10) Patent No.: US 9,981,484 B1
(45) Date of Patent: May 29, 2018

(54) SYSTEM AND METHOD FOR FLAME TREATMENT OF PRINT SURFACES IN INKJET PRINTERS

(71) Applicant: Xerox Corporation, Norwalk, CT (US)

(72) Inventors: Steven R. Moore, Pittsford, NY (US); Douglas K. Herrmann, Webster, NY (US); Alexander J. Fioravanti, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 15/480,540

(22) Filed: Apr. 6, 2017

(51) Int. Cl.
*B41J 11/00* (2006.01)
*B41J 13/00* (2006.01)
*B41J 2/01* (2006.01)

(52) U.S. Cl.
CPC ..... *B41J 11/0015* (2013.01); *B41J 2/01* (2013.01); *B41J 13/0009* (2013.01)

(58) Field of Classification Search
CPC ..... B41J 11/0015; B41J 2/01; B41J 13/009; B41J 29/393
See application file for complete search history.

(56) References Cited

U.S. PATENT DOCUMENTS 3,999,089 A 12/1976 Barros
4,428,760 A 1/1984 Oh
6,077,638 A * 6/2000 Tanikawa ..... G03G 9/083 430/106.2
7,278,728 B2 10/2007 Desie et al.
8,769,786 B1 7/2014 Alexander et al.
2010/0021636 A1 1/2010 Jacke et al.
2015/0124032 A1 5/2015 De Mondt et al.
2017/0190820 A1* 7/2017 Kitagawa ..... B29C 59/02

FOREIGN PATENT DOCUMENTS

WO 2008/118088 A1 10/2008

OTHER PUBLICATIONS

Enercon Industries Corporation; Dyne-A-Flame Plasma Treater; 3 Pages; Enercon Industries Corporation, Menomonee Falls, WI, USA, www.enerconind.com/treating/flame/dyne-a-flame.
Angelo; DIY HHO Torch (Water Torch) for only $4; Instructables.com; 2016; 13 Pages; Autodesk, Inc.

* cited by examiner

*Primary Examiner* — Lamson Nguyen
(74) *Attorney, Agent, or Firm* — Maginot Moore & Beck LLP

(57) ABSTRACT

A method for applying flame treatments to a print surface on an object in an inkjet printer includes activating a hydrogen torch within the inkjet printer to generate a flame through a nozzle of the hydrogen torch and operating an actuator to move at least one of the print surface or the nozzle in a predetermined direction to apply the flame from the nozzle to the print surface. The method further includes adjusting a rate of fuel flow to the nozzle of the hydrogen torch to change a thermal output level of the flame with reference to a change in distance between the nozzle of the hydrogen torch and the print surface during the operating of the actuator.

20 Claims, 3 Drawing Sheets

SYSTEM AND METHOD FOR FLAME TREATMENT OF PRINT SURFACES IN INKJET PRINTERS

TECHNICAL FIELD

This disclosure is directed to systems and methods for applying flame treatments to objects, and, more particularly, to systems and methods for applying flame treatments to print surfaces of objects in inkjet printing systems.

BACKGROUND

Flame treatment processes for various products in industrial manufacturing settings are known to the art. In particular, some types of materials including polymers benefit from being exposed to flame prior to receiving additional coatings including, for example, ultraviolet (UV) curable inks and other suitable coating materials that are applied using an inkjet printing system. The flame treatment process alters the surface of the polymer material to promote adhesion and spreading of the ink on the surface of the object. After an object has received the flame treatment in a specialized flame treatment system, the object later receives one or more additional material coatings in a separate coating system. For example, inkjet printing systems that are known to the art form printed ink images and coatings on the three-dimensional surfaces of different objects to provide monochrome and multi-color text and graphics, and transparent protective coatings to the objects.

While the benefits of flame treatment processes are generally known to the art, existing flame treatment systems cannot be used in many practical situations because these systems are specifically designed for large scale manufacturing in industrial settings. For example, one flame treatment system that is known to the art employs a robotic arm that passes a liquefied petroleum gas torch over various objects in a carefully controlled environment within an industrial-scale manufacturing process. These flame treatment systems can be effective in industrial settings for high-volume mass production of different items that receive flame treatments as part of a manufacturing process. However, the underlying technology that is used in the industrial scale manufacturing processes is also incompatible with newer "on-demand" manufacturing devices such as the inkjet printers that are used in small retail spaces and other environments that lack the infrastructure to support existing flame treatment systems. The existing flame treatment systems cannot be combined with these inkjet printers because the existing flame treatment systems consume large amounts of hydrocarbon fuels such as liquefied petroleum gas, propane, and natural gas. These systems are impractical for use with a self-contained inkjet printer. Consequently, improvements to flame treatment systems that are suitable for integration into inkjet printers would be beneficial.

SUMMARY

In one embodiment, a method for applying flame treatment to a print surface in an inkjet printer has been developed. The method includes activating a hydrogen torch within the inkjet printer to generate a flame through a nozzle of the hydrogen torch, operating an actuator to move at least one of the print surface or the nozzle in a predetermined direction to apply the flame from the nozzle to the print surface, and adjusting, with a controller and at least one valve in the hydrogen torch, a rate of fuel flow to the nozzle of the hydrogen torch to change a thermal output level of the flame with reference to a change in distance between the nozzle of the hydrogen torch and the print surface during the operating of the actuator.

In another embodiment, an inkjet printer that applies flame treatment to a print surface of an object has been developed. The inkjet printer includes a housing, a part holder positioned with the housing, the part holder being configured to hold an object, a hydrogen torch positioned within the housing, an actuator positioned with the housing and operatively connected to at least one of the hydrogen torch and the part holder, and a controller operatively connected to the hydrogen torch and the actuator. The hydrogen torch includes a nozzle configured to emit a flame generated by the hydrogen torch and at least one valve configured to adjust a rate of fuel flow to the nozzle. The controller is configured to activate the hydrogen torch to generate the flame through the nozzle of the hydrogen torch, operate the actuator to move at least one of the print surface or the nozzle in a predetermined direction to apply the flame from the nozzle to the print surface, and adjust the rate of fuel flow to the nozzle of the hydrogen torch with the at least one valve to change a thermal output level of the flame with reference to a change in distance between the nozzle of the hydrogen torch and the print surface during the operation of the actuator.

BRIEF DESCRIPTION OF THE DRAWINGS

The foregoing aspects and other features of an inkjet printer that applies flame treatments to print surfaces are explained in the following description, taken in connection with the accompanying drawings.

DETAILED DESCRIPTION

Figure 1:
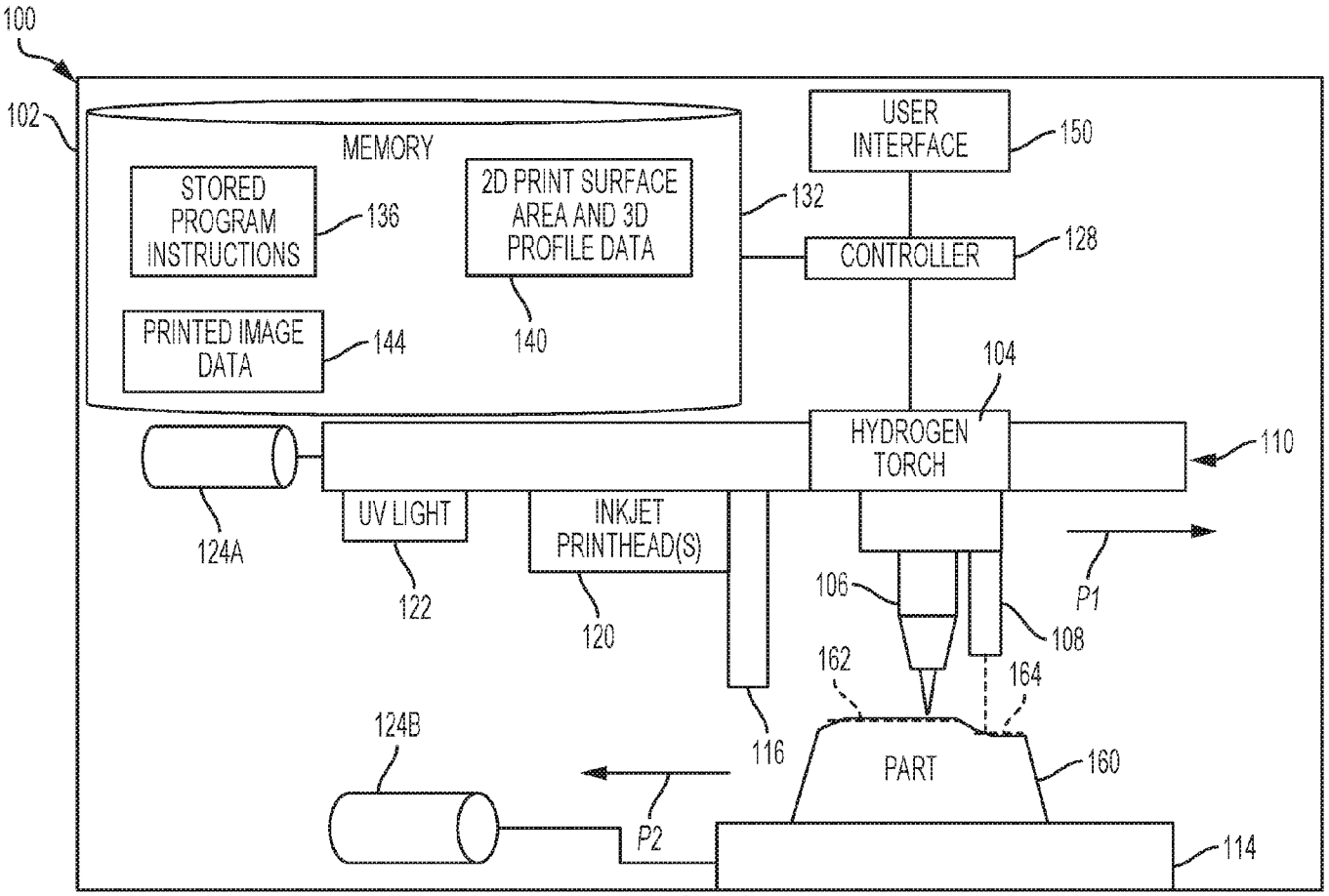
FIG. 1 is schematic diagram of an inkjet printer that applies a flame treatment to an object using a hydrogen torch prior to a printing operation.

For a general understanding of the environment for the embodiments disclosed herein as well as the details for the embodiments, reference is made to the drawings. In the drawings, like reference numerals designate like elements.

As used herein, the term "hydrogen torch" refers to a device within an inkjet printer that generates a flame via the combustion of hydrogen ($H_2$) and oxygen ($O_2$) molecules. The byproducts of the combustion are heat and water ($H_2O$), which is typically generated in the form of water vapor. In the embodiments described herein, the hydrogen torch includes an electrolysis system that generates the hydrogen and oxygen for combustion by application of electricity to water that is mixed with an electrolyte such as sodium bicarbonate or another suitable electrolyte.

In an inkjet printer, the hydrogen torch generates the heat to perform a flame treatment process on a surface of an object prior to operation of one or more inkjet printheads in the printer to form a printed image on the surface of the object. As used herein, the term "print surface" refers to the surface of the object that receives the flame treatment and the ink drops that form the printed image. Objects that are formed from various materials that are suitable for receiving a flame treatment prior to a printing operation include, but not limited to, polyolefin polymers including polyethylene (PE), high-density polyethylene (HDPE), polypropylene (PP), polymethylpentene (PMP), and polybutene-1 (PB-1) thermoplastics. The flame treatment improves the degree of spreading and adhesion of individual ink drops in the printed image to the print surface, which improves the quality of printed images by reducing or eliminating streaking and smudging of the ink drops in the printed image.

FIG. 1 is a schematic diagram of selected components of an inkjet printer 100 that includes a flame treatment device in the form of a hydrogen torch. The printer 100 includes a housing 102 that contains the hydrogen torch 104 with a nozzle 106, a displacement sensor 108, a part holder 114, an optional thermal barrier 116 between the nozzle 106 and one or more inkjet printheads 120, an ultraviolet (UV) light 122, actuators 124A and 124B, a digital controller 128, memory 132, and a user interface device 150. In the illustrative embodiment of FIG. 1, the printer 100 is depicted during a flame treatment operation in which the hydrogen torch 104 generates a flame through the nozzle 106 that is applied to a print surface of an object 160, which is also referred to as a "part", on the part holder 114.

In the printer 100, the part holder 114 is depicted as a flat tray that supports the object 160 to enable the torch nozzle 106 to apply a flame treatment to a print surface on the object 160 and for the inkjet printhead 120 to eject ink drops onto the print surface. In other embodiments, the part holder 114 includes clamps, vacuum suction orifices, and other attachment mechanisms that hold the object 160 securely in place during operation of the printer 100. Additionally, in some embodiments the part holder 114 orients the object 160 about a rotational axis of the object 160 within the printer 100 with only a base or other non-printed surface of the object 160 being directly attached to the part holder 114. This configuration enables the printer 100 to apply flame treatments and printed images in an "all around" printing operation on many common objects such as cups, pens, cases, and any other object that receives a printed image that wraps around multiple sides of an object.

In the illustrative embodiment of FIG. 1, the printer 100 includes an inkjet printhead 120 having at least one inkjet that is configured to eject drops of an ink onto a print surface of an object, such as the object 160. While FIG. 1 depicts a single inkjet printhead 120 for illustrative purposes, other embodiments include arrays of multiple inkjet printheads that eject different colors of ink and other materials onto the print surface. In one configuration the printhead 120 includes an array of inkjets that eject drops of a UV curable ink, or other suitable form of ink, onto a print surface. In the printer 100, the UV light source 122 exposes printed patterns of the UV curable inks to ultraviolet light that cures the printed ink patterns to form durable printed images and coatings on the surface of the object 160. The printer 100 optionally includes a thermal barrier 116 that isolates the inkjet printhead 120 from the flame that is emitted from the torch nozzle 106. The thermal barrier 116 is, for example, a member formed from a ceramic, glass-fiber, or other heat resistant material that prevents excess levels of heat from the torch flame emitted from the torch nozzle 106 from affecting the inkjet printhead 120. In other embodiments of the printer 100, the printheads are separated from the torch nozzle with sufficient distance that no thermal barrier is required.

In the illustrative embodiment of FIG. 1, the print surface is the upper surface of the object 160 including regions 162 and 164. In some embodiments, an array of multiple inkjet printheads or different groups of inkjets in a single printhead eject different colors of ink, such as a cyan, magenta, yellow, or black (CMYK) inks, to form multi-color printed images. The inkjet printhead 120 optionally ejects an optically transparent protective coating material onto the print surface, either directly or over a previously printed image. As described in more detail below, the controller 128 controls the timing of operation of individual inkjets in the printheads based on stored image data 144 to generate printed text and graphics on a print surface of the object 160.

FIG. 1 depicts two actuators 124A and 124B in the printer 100, although in alternative printer embodiments only one of the actuators 124A and 124B is present in a printer. The actuator 124A is operatively connected to an assembly 110 that includes the hydrogen torch nozzle 106 and displacement sensor 108, the inkjet printhead 120, and the UV light 122. The actuator 124A moves the assembly 110 in a first predetermined process direction P1 during a flame treatment process to pass the torch nozzle 106 over the surface print surface of the object 160 including portions of the print surface 162 and 164 that are located at different distances from the torch nozzle 106 due to the shape of the object 160. During a printing operation that occurs after flame treatment of the object 160, the actuator 124 also moves the assembly 110 with the printhead 120 and UV light 122 over the print surface of the object 160 during one or more printing passes to form a printed image. The actuator 124B is operatively connected to the part holder 114. During the flame treatment process, the actuator 124B moves the part holder 114 in a second predetermined process direction P2 to enable the torch nozzle 106 to apply the flame to the print surface in at least regions 162 and 164 on the object 160. While FIG. 1 depicts two actuators 124A and 124B, those of skill in the art will recognize that some printer embodiments include actuators that move only one of the printhead and the hydrogen torch nozzle assembly or the object holder to produce relative motion for the application of flame treatments and for printing operations.

In the printer 100, the controller 128 is a digital logic device such as a microprocessor, microcontroller, field programmable gate array (FPGA), application specific integrated circuit (ASIC) or any other digital logic that is configured to operate the printer 100. The controller 128 is operatively connected to the hydrogen torch 104, the displacement sensor 108, the inkjet printhead 120, either or both of the actuators 124A/124B, and the user interface device 150. The controller 128 is also operatively connected to a memory 132. In the embodiment of the printer 100, the memory 132 includes volatile data storage devices, such as random access memory (RAM) devices, and non-volatile data storage devices such as solid-state data storage devices, magnetic disks, optical disks, or any other suitable data storage devices. The memory 132 stores programmed instruction data 136, a database including either or both of two-dimensional print surface area and three-dimensional profile data 140, and image data 144 that the controller 128 uses to operate the inkjet printhead 120 to form printed images on the print surface of the object 160 or other objects. The controller 128 executes the stored program instructions 136 to operate the components in the printer 100 to apply a flame treatment to the print surface of the object 160 and to form printed images on the print surface of the object 160.

In the memory 132, the two-dimensional area data 140 include, for example, an aggregate two-dimensional surface area for a print surface of a three-dimensional object. The three-dimensional profile data 140 include the total two-dimensional area for the print surface and further include a set of depth information for different regions of the area that provides information for both the total area in two-dimensions and the three-dimensional data corresponding to the distance between the nozzle 106 and the print surface over different portions of the print surface. In some configurations, the controller 128 uses either the two-dimensional area data or the three-dimensional profile data to generate an estimate of the amount of hydrogen and oxygen fuel that the hydrogen torch 104 consumes during the flame treatment process of the print surface. The two-dimensional area data are simpler to process but provide an estimate of fuel consumption that may be less precise since the printer 100 adjusts the level of fuel consumption for the hydrogen torch based on the distance between the nozzle 106 and the print surface on the object, which often varies during the flame treatment process. The three-dimensional profile data can enable the controller 128 to generate a more precise estimate of fuel consumption for the flame treatment process but require more complex computations to produce the estimate. Either embodiment is suitable for use with the printer 100.

Figure 3:
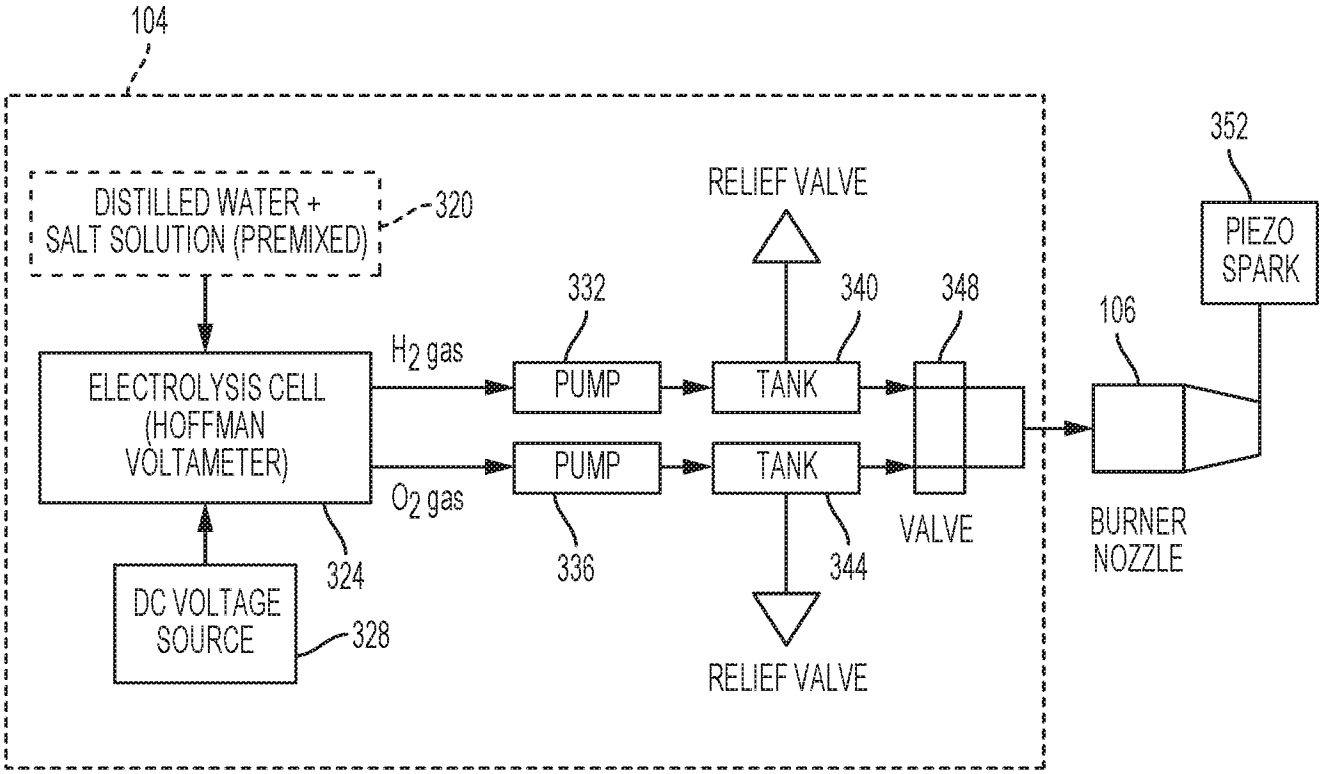
FIG. 3 is schematic diagram depicting the hydrogen torch of the printer of FIG. 1 in more detail.

FIG. 3 depicts the hydrogen torch 104 in the inkjet printer 100 in more detail. The hydrogen torch 104 includes a fluid reservoir 320, at least one electrolytic cell 324 that receives an electrical current from a direct current (DC) voltage source 328, pumps 332 and 336, gas storage tanks 340 and 344, at least one flow control valve 348, the burner nozzle 106, and a piezoelectric spark device 352. In the torch 104, the fluid reservoir 320 stores a mixture of distilled water and a salt, such as sodium bicarbonate, that acts as an electrolyte for the production of hydrogen and oxygen during an electrolysis process. The fluid reservoir 320 provides the water and salt to the electrolytic cell 324.

In FIG. 3, the electrolytic cell 324 is embodied as a Hoffman voltammeter cell, but can be embodied as any suitable electrolytic cell that operates using an electrical current. The electrolytic cell 324 includes two electrodes that are both connected to the DC power source 328 with one electrode producing a positive charge and the other electrode producing a negative charge during operation of the electrolytic cell. The two electrodes are separated from one another and immersed in the water and salt solution. In some embodiments, either or both of the electrodes in the electrolytic cell 324 include a catalyst that improves the efficiency of the electrolytic process. During operation of the electrolytic cell 324, the DC voltage source 328 generates an electrical current between the electrodes. The electrical current separates the hydrogen atoms and oxygen atoms that form water molecules in the solution. The gaseous hydrogen ($H_2$) has a positive charge and collects near the negatively charged electrode in the cell while the gaseous oxygen ($O_2$) has a negative charge and collects near the positively charged electrode in the cell, which enables separation of the gasses for extraction from the electrolytic cell 324. As used herein, the term "fuel" refers to the gaseous hydrogen and, in some embodiments, the gaseous oxygen that the electrolytic cell 324 generates for combustion in the hydrogen torch 104. As is known in the art from stoichiometry, the electrolytic cell 324 produces twice as many hydrogen molecules as oxygen molecules since the water molecule includes two hydrogen atoms but only one oxygen atom and the gases are maintained in the electrolytic cell 324 at approximately equal pressures and temperatures. Consequently, the electrolytic cell 324 produces the hydrogen gas and oxygen gas with a volumetric ration of approximately 2 to 1 (e.g. approximately double an amount of hydrogen gas for any given amount of oxygen gas produced at similar pressure and temperature levels, which is generally known to the art from Avogadro's law). While FIG. 3 depicts a single electrolytic cell 324, in other embodiments an array of electrolytic cells produces hydrogen and oxygen gas in the same manner as the electrolytic cell 324.

In the hydrogen torch 104, the pumps 332 and 336 extract the $H_2$ gas and $O_2$ gas, respectively, from the electrolytic cell 324. The pump 332 delivers the $H_2$ gas to an inlet of first storage tank 340 and the pump 336 delivers the $O_2$ gas to an inlet of a second storage tank 344. Each of the storage tanks 340 and 344 includes a relief valve to vent gas to the atmosphere in the event that the pressure levels of the gas exceed the operating pressure of the tanks. In some embodiments, each of the tanks 340 and 344 includes a pressure sensor that enables an external controller, such as the controller 128 in the printer 100, to monitor an amount of gas that is stored in each tank based on the pressure level within the tank. As described above, the electrolytic cell 324 produces a volume of $H_2$ gas that has approximately twice the volume of the generated $O_2$ gas at equivalent pressure and temperature levels. In the hydrogen torch 104, the $H_2$ storage tank 340 is either larger than the $O_2$ storage tank 344, rated to store the $H_2$ at a higher pressure level, or includes a combination of both a larger size and higher pressure rating to enable the $H_2$ storage tank 340 to store approximately twice the number of $H_2$ molecules compared to the number of $O_2$ molecules that are stored in the $O_2$ storage tank 344. In one embodiment of the printer 100, both of the tanks 340 and 344 are rated to store compressed hydrogen or oxygen at a pressure level of 20 pounds per square inch (PSI).

The hydrogen torch 104 of FIG. 3 includes the pump 336 and storage tank 344 for $O_2$ gas to enable high-efficiency combustion of stored $O_2$ gas with the $H_2$ gas from the tank 340. However, since the ambient atmosphere already includes gaseous $O_2$, a simplified embodiment of the hydrogen torch 104 omits the pump 336 and tank 344 to enable combustion of the hydrogen with atmospheric oxygen. In the simplified embodiment, the hydrogen torch includes a vent to provide a controlled release of the $O_2$ gas that is generated in the electrolytic cell 324.

In the hydrogen torch 104, the tanks 340 and 344 include outlet openings that are connected to inlets of the flow control valve 348. The flow control valve 348 is a variable valve that can control a rate of flow of the hydrogen and oxygen fuel from the tanks 332 and 336 to the nozzle 106. An external controller, such as the controller 128 in the printer 100, is operatively connected to the flow control valve 348. While the hydrogen torch 104 depicted in FIG. 3 includes a single flow control valve 348 with two inlets and a single outlet, which is connected to the burner 106, another embodiment includes a first valve that is connected to the $H_2$ tank 340 and a second valve that is connected to the $O_2$ tank 344 with the combined outputs of the valves providing the $H_2$ and $O_2$ to the burner nozzle 106.

During operation, the controller operates the flow control valve to control the rate of flow of fuel through the valve 348 to the burner nozzle 106, which changes the thermal output level of the flame through the nozzle 106 during operation of the hydrogen torch 104. In the configuration of FIG. 3 the fuel is a mixture of the gaseous hydrogen and oxygen from the tanks 340 and 344, respectively, and the flow control valve 348 is configured to enable a proportional flow of the fuel including approximately twice the rate of flow of hydrogen gas as oxygen gas to the burner nozzle 106 since combustion of the fuel consumes two hydrogen atoms and one oxygen atom to produce each water molecule ($2H_2+O_2 \rightarrow 2H_2O$). In a closed configuration, the flow control valve 348 completely shuts off the flow of the hydrogen and oxygen fuel to the burner nozzle 106 to deactivate the torch 104. When the torch is activated, the flow control valve 348 controls the rate of hydrogen and oxygen fuel flow to the burner nozzle 106 in a range of thermal output levels between a predetermined minimum flow level that produces a minimum operational thermal output level and a maximum flow level that produces a maximum thermal output level during operation of the torch 104.

In the hydrogen torch 104, the nozzle 106 receives the fuel including the mixture of $H_2$ and $O_2$ gas from the flow control valve 348. The nozzle 106 directs the fuel to an outlet where the fuel ignites to produce a torch flame that is applied to the print surface of an object in the printer 100. To activate the hydrogen torch 104, an external control device, such as the controller 128 in the printer 100, generates an electrical signal that operates a piezoelectric spark device 352 to ignite the fuel that is emitted from the nozzle 106. The piezoelectric spark device 352 is activated to ignite the hydrogen torch 104 and, if necessary, to reignite the hydrogen torch 104 if the flame from the nozzle 106 is inadvertently extinguished during operation.

In the hydrogen torch 104, the electrolytic cell 324 generates hydrogen and oxygen gas independently of the operation of the hydrogen torch 104 to generate a flame via the nozzle 106. For example, in one mode of operation the DC voltage source 328 operates the electrolytic cell 324 to generate hydrogen and oxygen gasses that are stored in the tanks 340 and 344, respectively, prior to activation of the hydrogen torch 104. This configuration of the hydrogen torch 104 enables the use of an electrolytic cell 324 to generate the hydrogen and oxygen fuel at a rate that is below the rate of fuel consumption for the hydrogen torch 104 during operation, since the tanks 340 and 344 store a supply of fuel. Consequently, the printer 100 can utilize a smaller array of electrolytic cells 324 than are otherwise required to generate the fuel at the full rate of consumption for the hydrogen torch 104.

In one practical embodiment of the inkjet printer 100, the hydrogen torch 104 activates to produce a flame during approximately 25% of the time that the printer 100 is activated, while the printer 100 performs other operations such as inkjet printing or curing of printed images during which the hydrogen torch 104 is deactivated and does not produce a flame during the remaining 75% of the operational time in the printer. In this embodiment, the electrolytic cells generate a total volume of the hydrogen and oxygen fuel at a rate of approximately 18 liters per hour at standard temperature and pressure (STP), although different printer embodiments include electrolytic cells that produce the hydrogen and oxygen fuel at lower or higher rates. In the printer 100, the electrolytic cells 324 may be activated to generate the hydrogen and oxygen fuel while the hydrogen torch 104 is deactivated or during periods when the hydrogen torch 104 is both deactivated and activated to maintain a supply of fuel.

Referring again to FIG. 1, the displacement sensor 108 is, for example, a laser or optical rangefinder that generates data corresponding to a distance from the displacement sensor 108 to the print surface on the object 160. In the printer 100, the displacement sensor is mounted in a predetermined location relative to the nozzle 106, such as adjacent to the torch nozzle 106 as depicted in FIG. 1, to enable the controller 128 to identify the distance between the torch nozzle 106 and different portions of the print surface as each portion of the print surface approaches the torch nozzle along the process directions P1 or P2. For example, the controller 128 identifies a first distance between the torch nozzle 106 and the first portion of the print surface 162 and a second distance between the torch nozzle 106 and the second portion of the print surface 164 based on the data from the displacement sensor 108 before the torch nozzle passes over either portion of the print surface. As described below, the controller 128 controls the thermal output level of the hydrogen torch 104 to apply an even flame treatment to the non-uniform print surface on the object 160.

Referring to FIG. 1 and FIG. 3, during a flame treatment operation of the printer 100, the controller 128 operates the hydrogen torch 104 to generate a flame through the nozzle 106 with varying thermal output levels based on the distance between the nozzle 106 and the print surface on the object 160. Since the object 160 is a three-dimensional object that in many configurations has a print surface with portions that vary in distance from the torch nozzle 106, the controller 128 uses data from the displacement sensor 108 to identify the relative distance of different portions of the print surface from the nozzle 106 and adjusts level of fuel and corresponding thermal output level of the hydrogen torch 104 to apply the flame treatment. For example, in FIG. 1 the displacement sensor 108 generates a first distance measurement to the first portion 162 of the print surface and a second distance measurement to the second portion 164 of the print surface prior to these portions of the print surface passing the torch nozzle 106. The controller 128 operates the flow control valve 348 to produce a first level of fuel flow and corresponding thermal output level of the hydrogen torch 104 as the first portion 162 passes the torch nozzle 106 and operates the flow control valve 348 to produce a second level of fuel flow and corresponding thermal output level of the hydrogen torch 104 as the second portion 164 passes the torch nozzle 106. In the example of FIG. 1, the first level of fuel flow and the first thermal output level are lower than the second level of fuel flow and the second thermal output level because the first distance between the torch nozzle 106 and the first portion of the print surface 162 is less than the second distance between the torch nozzle 106 and the second portion of the print surface 164. Thus, the controller 128 adjusts the rate of fuel flow and corresponding output thermal power levels of the hydrogen torch 104 based on the distance between the torch nozzle 106 and the print surface to ensure that the entire print surface receives a flame treatment that delivers sufficient thermal energy to be effective but that does not apply an excess amount of thermal energy that could potentially damage the print surface.

In some configurations, the controller 128 identifies an estimated amount of fuel needed to apply the flame treatment to the print surface of the object 160 based on the two-dimensional area data or three-dimensional profile data 140 that are stored in the memory 132. The controller 128 operates the electrolytic cell 324 in the hydrogen torch 104 to generate a supply of hydrogen and oxygen fuel prior to commencing the flame treatment operation to ensure that the hydrogen torch 104 has a sufficient supply of fuel to complete the flame treatment operation without interruption.

In some embodiments, the controller 128 receives a stock keeping unit (SKU) number or other input identifier for an object via the user interface device 150. The user interface device 150 is, for example, push-button, keypad, or touch-screen interface that enables an operator to control the printer 100 and, in at least one operating mode, receive the SKU from the operator. In another configuration, the user interface device 150 is a network interface device such as a wired or wireless network adapter that enables the printer to receive the SKU and other control information from a remote computing system. The controller 128 identifies the two-dimensional surface area or three-dimensional profile data for the print surface of the object 160 using the input identifier and a database that contains the stored two-dimensional area and three-dimensional profile data 140. In one embodiment, the controller 128 retrieves the predetermined area and three-dimensional profile data from an external database (e.g. a web server or other network-connected database) using the SKU number or other identifier as a search key. In another configuration, the controller 128 generates an estimate of the surface area or three-dimensional profile of the object 160 using the displacement sensor 108 to perform multiple passes over the object 160 while the hydrogen torch 104 is deactivated. The controller 128 then stores the estimated area or three-dimensional profile information 140 in the memory 132 for subsequent flame treatment and printing operations on additional copies of the same object.

Figure 2:
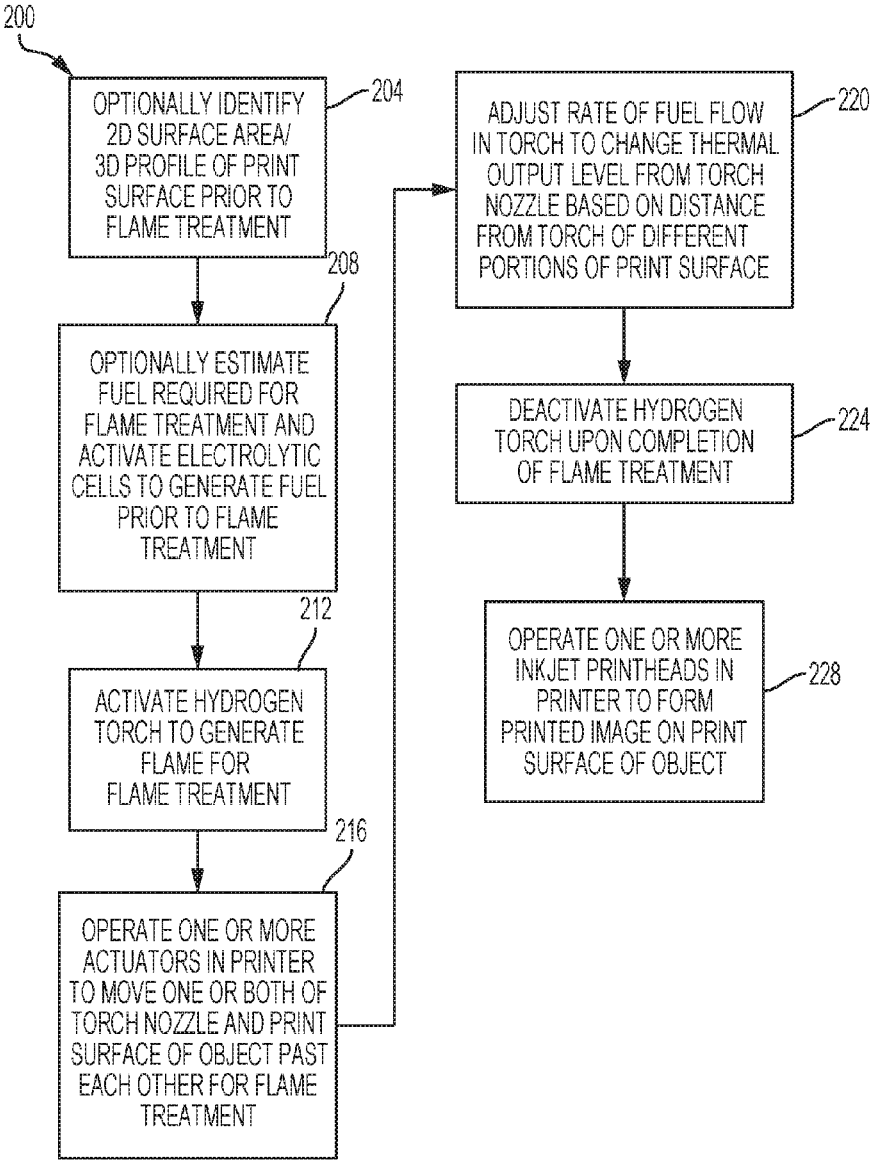
FIG. 2 is block diagram of a process 200 for flame treatment and inkjet printing of an object in an inkjet printer.

FIG. 2 depicts a process 200 for operation of an inkjet printer to apply a flame treatment and to print an image on a print surface of an object. In the description below, a reference to the process 200 performing a function or action refers to the operation of a controller to execute stored program data to perform the function or action in association with other components in an inkjet printer. The process 200 is described in conjunction with the printer 100 and the embodiments of FIG. 1 and FIG. 3 for illustrative purposes.

During the process 200, the printer 100 optionally identifies either or both of the two-dimensional surface area and the three-dimensional profile of the print surface prior to commencing the flame treatment (block 204). As described above, in some embodiments the controller 128 identifies the two-dimensional surface area or the three-dimensional profile data from the database of the surface area and profile data 140 that are stored in the memory 132 using, for example, the SKU number or other identifier that is received from the user interface device 150. In another embodiment, the controller 128 operates the displacement sensor 108 and one or both of the actuators 124A/124B to scan the print surface by performing one or more passes over the print surface, such as the surface of the object 160 in FIG. 1. The controller 128 identifies either or both of the two-dimensional surface area and the three-dimensional profile of the print surface, such as the first portion 162 and second portion 164 that are depicted in FIG. 1, based on the distance measurement data from the displacement sensor 108.

The process 200 continues as the controller 128 optionally generates an estimate of the amount of fuel that is required to apply the flame treatment to the print surface and activates the electrolytic cell to produce fuel, if necessary, based on the estimate (block 208). As described above, the controller 128 generates the estimate of the required fuel consumption to apply flame treatment to the print surface based on either the two-dimensional surface area or the three-dimensional profile data for the print surface. The controller 128 also uses predetermined characteristics of the hydrogen torch 104 to generate the estimate. The predetermined characteristics include, for example, predetermined fuel flow rates for different thermal output levels of the hydrogen torch 104, the velocity of movement for the torch nozzle 106 during each pass over the print surface of the object 160, the surface area that receives the flame treatment from the torch nozzle 106 during each pass, and the corresponding number of passes that are required to cover the entire area of the print surface. The controller 128 identifies the available fuel level in the hydrogen torch 104 based on pressure levels in the hydrogen tank 340 and the oxygen tank 344. The controller 128 activates the DC electrical power source 328 to generate additional hydrogen and oxygen with the electrolytic cell 324 as needed until the hydrogen torch 104 has a sufficient supply of fuel available to perform the flame treatment process based on the estimated fuel consumption requirement.

The process 200 continues as the controller 128 activates the hydrogen torch 104 to generate the flame for flame treatment (block 212). In the embodiment of FIG. 3, the controller 128 operates the flow control valve 348 to produce a flow of hydrogen and oxygen gases from the tanks 340 and 344, respectively, through the nozzle 106. The controller 128 operates the piezoelectric spark device 352 to generate one or more sparks to ignite the fuel and produce the flame through the nozzle 106. The process 200 continues as the controller 128 operates at least one of the actuators 124A/124B to move either of the torch nozzle 106 or the object 160 along the process directions P1 or P2, respectively, to apply the flame from the torch to the print surface on the object 160 (block 216).

As the torch nozzle 106 moves relative to the print surface of the object 160, the displacement sensor 108 generates measurement data that indicates the distance between the nozzle 106 and the print surface over different portions of the print surface, such as the portions 162 and 164 that are depicted in FIG. 1. The controller 128 adjusts the fuel flow rate through the flow control valve 348 to adjust the thermal output level of the hydrogen torch 104 through the nozzle 106 based on the distance between the nozzle 106 and the print surface to apply a consistent level of thermal energy to each portion of the print surface during the flame treatment process (block 220). As depicted in FIG. 1, the controller 128 uses the measurement data from the displacement sensor 108 to identify a first distance between the torch nozzle 106 and the first portion of the print surface 162 and a second distance between the torch nozzle 106 and the second portion of the print surface 164. The controller 128 operates the flow control valve 348 to adjust the rate of fuel flow to the nozzle 106 based on the distance measurement data received from the displacement sensor 108.

In the example of FIG. 1, the controller 128 operates the flow control valve 348 to reduce the flow of fuel to the nozzle while the torch nozzle 106 moves over the first portion of the print surface 162 relative to a higher rate of fuel flow while the nozzle moves over the second portion of the print surface 164. The controller 128 adjusts the rate of fuel flow to generate the flame with a lower thermal output level over the print surface portion 162 that is located closer to the nozzle 106 compared to the print surface portion 164 that is located at a larger distance from the nozzle 106. The controller 128 adjusts the rate of fuel flow and corresponding thermal output levels from the hydrogen torch 104 based on the distance measurement data from the displacement sensor 108 to apply a consistent level of thermal energy from the hydrogen torch 104 to each portion of the print surface even as the distance between the torch nozzle 106 and the print surface varies during the flame treatment process.

During the process 200, the printer 100 operates one or both of the actuators 124A/124B to perform multiple passes between the torch nozzle 106 and the print surface on the object 160 to enable the torch nozzle 106 to apply the flame treatment to the entire print surface prior to a printing operation in the printer 100. FIG. 1 depicts a single pass of the torch nozzle 106 over the surface of the object 160, but the actuators 124A/124B translate the location of the torch nozzle 106 laterally between each pass to enable the torch nozzle 106 to cover the entire print surface. The printer 100 performs multiple passes between the torch nozzle 106 and the print surface of the object 160 as described above with reference to the processing of blocks 212-220 in a similar manner to a multi-pass printing operation using the inkjet printhead 120, although in some configurations the printer 100 performs a different number of passes during the flame treatment process compared to the printing process since the effective width of the flame from the nozzle 106 may be different than the effective width of the printed patterns of ink drops from printhead 120 during each pass.

After the completion of the flame treatment process, the controller 128 deactivates the hydrogen torch 104 (block 224) and operates one or more inkjet printheads in the printer to form a printed image on the flame treated print surface (block 228). In the printer 100, the controller 128 closes the flow control valve 348 to deactivate the hydrogen torch 104. As described above, in some configurations the controller 128 activates the DC electrical source 328 to generate additional fuel using the electrolytic cell 324 while the hydrogen torch 104 is deactivated to produce a supply of hydrogen and oxygen gas fuel for a subsequent flame treatment process. In the printer 100, the controller 128 operates the actuators 124A/124B to perform one or more passes between the printhead 120 and the flame treated print surface on the object 160. The controller 128 uses the stored image data 144 to form printed patterns including text, graphics, and optionally protective coatings on the print surface of the object 160. In the illustrative embodiment of FIG. 1, the controller 128 also activates the UV light source 122 to cure the ink drop patterns on the print surface of the object 160 to form durable printed images. The flame treatment process that the printer 100 performs during the process 200 improves the adhesion and wettability of the ink on the print surface of the object 160, which enables the printer 100 to produce high quality and durable printed images using a flame treatment process that is performed entirely within the inkjet printer 100.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method for applying flame treatment to a print surface in an inkjet printer comprising:

activating a hydrogen torch within the inkjet printer to generate a flame through a nozzle of the hydrogen torch;

operating an actuator to move at least one of the print surface or the nozzle in a predetermined direction to apply the flame from the nozzle to the print surface; and adjusting, with a controller and at least one valve in the hydrogen torch, a rate of fuel flow to the nozzle of the hydrogen torch to change a thermal output level of the flame with reference to a change in distance between the nozzle of the hydrogen torch and the print surface during the operating of the actuator.

2. The method of claim 1 further comprising:

operating, with the controller, an inkjet printhead in the printer to eject drops of ink onto the print surface after applying the flame to the print surface.

3. The method of claim 1 further comprising:

identifying, with the controller and a displacement sensor in the inkjet printer, a first distance between the nozzle and a first portion of the print surface prior to applying the flame to the first portion of the print surface;

identifying, with the controller and the displacement sensor, a second distance between the nozzle and a second portion of the print surface prior to applying the flame to the second portion of the print surface, the second distance being greater than the first distance;

adjusting, with the controller and the at least one valve, the rate of fuel flow to the nozzle of the hydrogen torch to generate a first thermal output level of the flame during application of the flame to the first portion of the print surface; and adjusting, with the controller and the at least one valve, the rate of fuel flow to the nozzle of the hydrogen torch to generate a second thermal output level of the flame during application of the flame to the second portion of the print surface, the second thermal output level being greater than the first thermal output level.

4. The method of claim 1 further comprising:

operating, with the controller, at least one electrolytic cell to generate hydrogen and oxygen as the fuel for the hydrogen torch prior to the activating of the hydrogen torch.

5. The method of claim 4 further comprising:

identifying, with the controller, a surface area of the print surface prior to the activating of the hydrogen torch;

generating, with the controller, an estimate of fuel consumption for the hydrogen torch with reference to the surface area of the print surface; and operating, with the controller, the electrolysis device to generate a first amount of hydrogen and a second amount of oxygen for the hydrogen torch corresponding to the estimate of fuel consumption for the hydrogen torch prior to the activating of the hydrogen torch.

6. The method of claim 5, the identifying of the surface area further comprising:

receiving, with the controller, an identifier corresponding to a three-dimensional object that includes the print surface; and identifying, with the controller, the surface area of the print surface based on a predetermined database of objects store in a memory.

7. The method of claim 5 further comprising:

identifying, with the controller, a three-dimensional profile of the print surface prior to the activating of the hydrogen torch; and generating, with the controller, the estimate of fuel consumption for the hydrogen torch with reference to the surface area and the three-dimensional profile of the print surface.

8. The method of claim 7, the identifying of the there-dimensional profile of the print surface comprising:

operating the actuator to move at least one of the print surface or the nozzle in the predetermined direction while the hydrogen torch is deactivated; and generating, with a displacement sensor in the inkjet printer, the three-dimensional profile of the print surface during the operating of the actuator.

9. The method of claim 1, the adjusting of the rate of fuel flow to the nozzle of the hydrogen torch further comprising:

adjusting, with the controller and the at least one valve, a first rate of flow of hydrogen gas from a first tank in the hydrogen torch and a second rate of flow of oxygen gas from a second tank in the hydrogen torch to the nozzle for combustion, the first rate of flow being approximately twice the second rate of flow.

10. The method of claim 1, the adjusting of the rate of fuel flow to the nozzle of the hydrogen torch further comprising:

adjusting, with the controller and the at least one valve, a rate of flow of hydrogen gas from a tank in the hydrogen torch to the nozzle for combustion with atmospheric oxygen.

11. An inkjet printer comprising:

a housing;

a part holder positioned with the housing, the part holder being configured to hold an object;

a hydrogen torch positioned within the housing, the hydrogen torch comprising:

a nozzle configured to emit a flame generated by the hydrogen torch; and at least one valve configured to adjust a rate of fuel flow to the nozzle;

an actuator positioned with the housing and operatively connected to at least one of the hydrogen torch and the part holder; and a controller operatively connected to the hydrogen torch and the actuator, the controller being configured to:

activate the hydrogen torch to generate the flame through the nozzle of the hydrogen torch;

operate the actuator to move at least one of the print surface or the nozzle in a predetermined direction to apply the flame from the nozzle to the print surface; and adjust the rate of fuel flow to the nozzle of the hydrogen torch with the at least one valve to change a thermal output level of the flame with reference to a change in distance between the nozzle of the hydrogen torch and the print surface during the operation of the actuator.

12. The inkjet printer of claim 11, further comprising:

an inkjet printhead positioned within the housing, the inkjet printhead being configured to eject drops of ink onto the print surface of the object; and the controller being operatively connected to the inkjet printhead, the controller being further configured to:

operate the inkjet printhead to eject drops of ink onto the print surface after applying the flame to the print surface.

13. The inkjet printer of claim 11, further comprising:

a displacement sensor positioned within the housing at a predetermined location relative to the nozzle of the hydrogen torch; and the controller being operatively connected to the displacement sensor, the controller being further configured to:

identify a first distance between the nozzle and a first portion of the print surface with the displacement sensor prior to application of the flame to the first portion of the print surface;

identify a second distance between the nozzle and a second portion of the print surface with the displacement sensor prior to application of the flame to the second portion of the print surface, the second distance being greater than the first distance;

adjust the rate of fuel flow to the nozzle of the hydrogen torch with the at least one valve to generate a first thermal output level of the flame during application of the flame to the first portion of the print surface; and adjust the rate of fuel flow to the nozzle of the hydrogen torch with the at least one valve to generate a second thermal output level of the flame during application of the flame to the second portion of the print surface, the second thermal output level being greater than the first thermal output level.

14. The inkjet printer of claim 11, the hydrogen torch further comprising:

at least one electrolytic cell; and the controller being further configured to:

operate the at least one electrolytic cell to generate hydrogen and oxygen as the fuel for the hydrogen torch prior to the activation of the hydrogen torch.

15. The inkjet printer of claim 14, the controller being further configured to:

identify a surface area of the print surface prior to the activation of the hydrogen torch;

generate an estimate of fuel consumption for the hydrogen torch with reference to the surface area of the print surface; and operate the electrolysis device to generate a first amount of hydrogen and a second amount of oxygen for the hydrogen torch corresponding to the estimate of fuel consumption for the hydrogen torch prior to the activation of the hydrogen torch.

16. The inkjet printer of claim 15, the controller being further configured to:

receive an identifier corresponding to a three-dimensional object that includes the print surface; and identify the surface area of the print surface based on a predetermined database of objects store in a memory.

17. The inkjet printer of claim 15, the controller being further configured to:

identify a three-dimensional profile of the print surface prior to the activation the hydrogen torch; and generate the estimate of fuel consumption for the hydrogen torch with reference to the surface area and the three-dimensional profile of the print surface.

18. The inkjet printer of claim 17 further comprising:

a displacement sensor positioned within the housing at a predetermined location relative to the nozzle of the hydrogen torch; and the controller being operatively connected to the displacement sensor, the controller being further configured to:

operate the actuator to move at least one of the print surface or the nozzle in the predetermined direction while the hydrogen torch is deactivated; and generate with a displacement sensor in the inkjet printer, the three-dimensional profile of the print surface during the operation of the actuator.

19. The inkjet printer of claim 11, the hydrogen torch further comprising:

a first tank configured to store hydrogen gas;

a second tank configured to store oxygen gas; and the controller being further configured to:

adjust a first rate of flow of the hydrogen gas from the first tank and a second rate of flow of the oxygen gas from the second tank to the nozzle for combustion with the at least one valve, the first rate of flow being approximately twice the second rate of flow.

20. The inkjet printer of claim 11, the hydrogen torch further comprising:

a first tank configured to store hydrogen gas; and the controller being further configured to:

adjust a rate of flow of the hydrogen gas from the tank to the nozzle with the at least one valve for combustion with atmospheric oxygen.

* * * * *